US007743872B2

(12) United States Patent
Brookman

(10) Patent No.: US 7,743,872 B2
(45) Date of Patent: Jun. 29, 2010

(54) AIR START STEAM ENGINE

(76) Inventor: Michael Jeffrey Brookman, 34 Averill Pl., Branford, CT (US) 06405

( * ) Notice: Subject to any disclaimer, the term of this patent is extended or adjusted under 35 U.S.C. 154(b) by 325 days.

(21) Appl. No.: 11/770,022

(22) Filed: Jun. 28, 2007

(65) Prior Publication Data

US 2009/0000848 A1 Jan. 1, 2009

(51) Int. Cl.
*B60K 3/02* (2006.01)

(52) U.S. Cl. ..... 180/303; 180/302; 180/304; 180/310; 60/649; 60/651; 60/671

(58) Field of Classification Search ..... 180/302, 180/303, 304, 310; 60/649, 651, 671
See application file for complete search history.

(56) References Cited

U.S. PATENT DOCUMENTS 1,060,034 A * 4/1913 Stanley ..... 122/448.1
1,330,863 A * 2/1920 Griffin ..... 180/304
1,385,845 A * 7/1921 Scott ..... 122/448.1
1,671,121 A * 5/1928 Nordberg ..... 60/408
1,675,600 A 7/1928 Doble
3,518,975 A 7/1970 Schmidt
3,672,048 A 6/1972 Conwell
3,728,858 A 4/1973 Sorensen
4,437,308 A 3/1984 Fischer
4,489,563 A * 12/1984 Kalina ..... 60/673
4,590,766 A 5/1986 Striebich
4,708,849 A 11/1987 Mielnik, Jr. et al.
5,255,519 A 10/1993 Kakovitch
5,444,981 A 8/1995 Kakovitch
5,606,859 A 3/1997 Ploshkin
6,250,078 B1 * 6/2001 Amendola et al. ..... 60/509
6,523,347 B1 * 2/2003 Jirnov et al. ..... 60/651
6,834,503 B2 12/2004 Freymann
7,080,512 B2 7/2006 Schoell
7,104,348 B2 9/2006 Fasanello, Jr.
7,178,324 B2 2/2007 Sakita
7,203,593 B2 4/2007 Lepley et al.
7,314,104 B2 1/2008 Ketcham
2006/0064986 A1 3/2006 Ginter et al.
2006/0137922 A1 6/2006 Ketcham
2007/0163819 A1 7/2007 Richter et al.
2008/0087002 A1 4/2008 Zhou (Continued)

FOREIGN PATENT DOCUMENTS

WO WO 2006/024209 A1 3/2006

*Primary Examiner*—Lesley Morris
*Assistant Examiner*—Bryan A Evans
(74) *Attorney, Agent, or Firm*—Michael de Angeli

(57) ABSTRACT

A method and system for an external combustion engine operable using at least two different fluids to provide pressure volume work to an engine. The engine is started by providing a compressed fluid at a sufficient pressure to move internal components of the engine that in turn rotate a shaft to generate power. At the same time the compressed fluid is provided to the engine, a liquid fluid is provided to a heater to be heated. The liquid fluid is heated to its boiling point and converted to gas form. Additional heat is provided to increase the pressure of this gas fluid. Once the pressure is increased to a sufficient level, the gas fluid is injected into the engine to generate power. The gas is exhausted from the engine, and is cooled and separated back into the two separate fluids. The initial compressed fluid is recompressed for later use.

25 Claims, 2 Drawing Sheets

U.S. PATENT DOCUMENTS

2008/0229747 A1 9/2008 Yatsuzuka et al.
2008/0271454 A1 11/2008 Hansen
2008/0282701 A1 11/2008 Komaki et al.

* cited by examiner

AIR START STEAM ENGINE

TECHNICAL FIELD

The present invention is related to external combustion engines. More specifically, the present invention is related to an external combustion engine that is operable under two gaseous fluids.

BACKGROUND OF THE INVENTION

Steam engines and other external combustion engines have been known for years. They have been used on a variety of vehicles and equipment to perform work. For example, they have been used in steamboats, steam locomotives, as electrical generators and even in some of the very first automobiles. External combustion engines use a fuel source, such as wood or coal, to generate heat. Instead of burning the fuel to directly generate power, this heat is used to heat a liquid fluid such as water to its boiling point. Once the water becomes vapor, additional heat allows the pressure in a boiler to increase. It is this pressure that is needed to generate power to the engine.

Once the pressure in the boiler has reached the desired pressure point, the pressure causes portions of the engine to move. For example in a piston driven engine, the pressure that is built up in the boiler causes the pistons to move. The movement of the pistons transfers the power from the steam to the engine, and thus to a shaft or other rotating device. The steam in the cylinder cools as the piston expands in the cylinder. This cooled steam is either exhausted by the engine into the atmosphere or recovered for later use by the steam engine.

There are two problems commonly associated with steam engines that make their use in vehicles, especially on-demand vehicles such as personal automobiles, undesirable. First, steam engines typically require a significant amount of time to warm up and produce motive power. This could take upwards of 5-10 minutes to generate enough steam to move the vehicle at highway speeds. While this amount of time to warm up the boiler is sometimes acceptable in larger/scheduled vehicles, such as trains and boats, it is generally not acceptable in automobiles. Second, typical steam engines require a large storage area for storing the steam as it is generated, prior to injecting the steam into the engine. This large storage area takes up a considerable amount of space in a vehicle that would desirably be available for cargo or passengers.

BRIEF SUMMARY OF THE INVENTION

The present invention is directed to a method and system for an external combustion engine operable using at least two different fluids to provide pressure volume work. The engine is started by providing a compressed fluid at a sufficient pressure to move internal components of the engine that in turn rotate a shaft to generate power. At the same time the compressed fluid is provided to the engine, a liquid fluid is provided to a heater to be heated. The liquid fluid is heated to its boiling point and converted to gas form. Additional heat is provided to increase the pressure of this gas fluid. Once the pressure is increased to a sufficient level, the gas fluid is injected into the engine to generate power. The gas is exhausted from the engine, and is cooled and separated back into the two separate fluids. The initial compressed fluid is recompressed for later use.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 1:
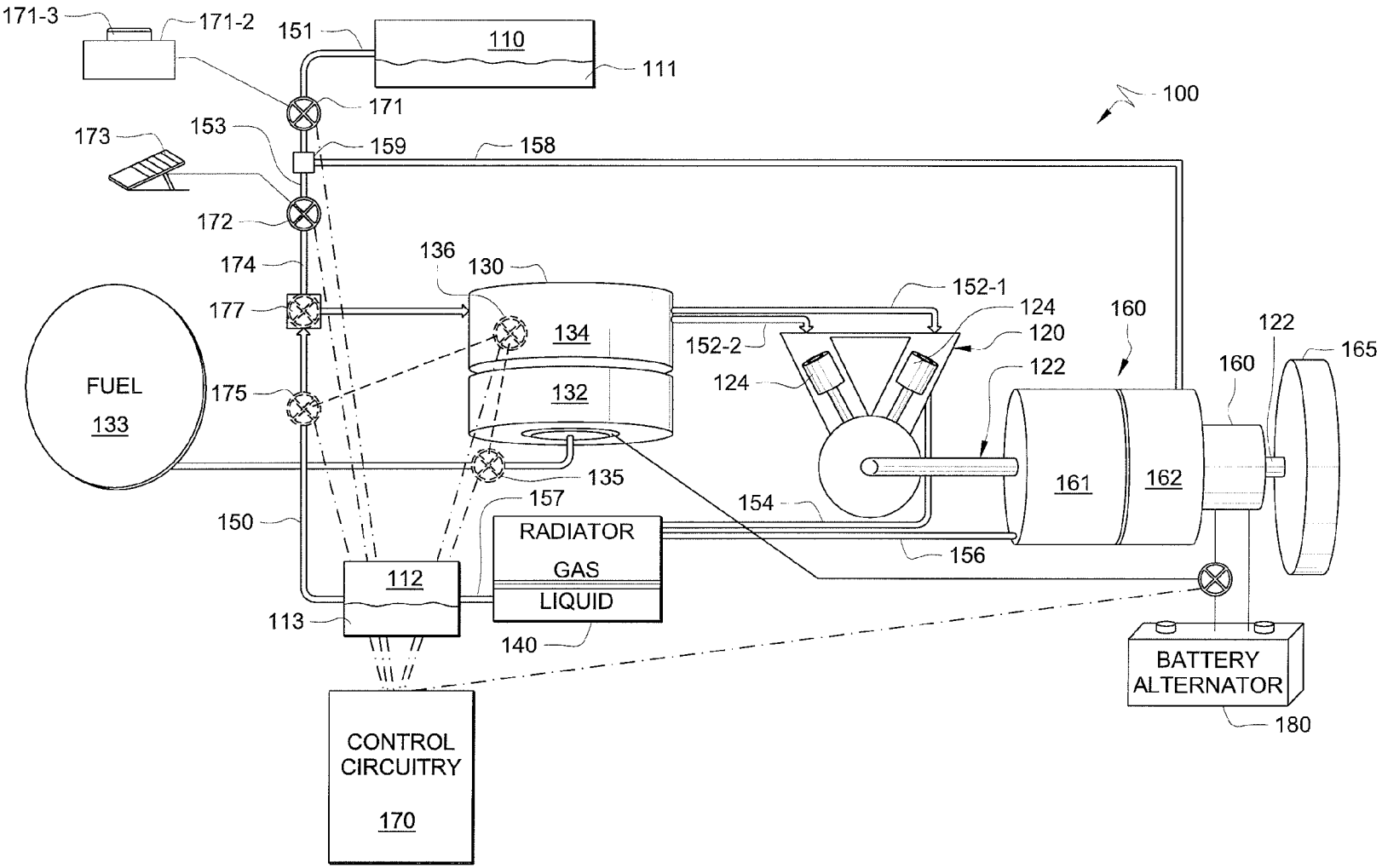
FIG. 1 is a block diagram illustrating various components of a power generation system according to one embodiment.

FIG. 1 is a schematic diagram of a power generation system 100 according to at least one embodiment of the present invention. In the present discussion power generation system 100 is located within a vehicle, such as an automobile; however, other usages are envisioned. Power generation unit 100 is powered by a combination of at least two fluids that are heated to achieve a gaseous state. Power generation unit 100 includes a first fluid storage vessel 110, a second fluid storage vessel 112, an engine 120, a heater 130, and a radiator 140. In one embodiment, power generation unit 100 is a closed system. By closed system, it is meant that the fluids that are used to produce the power are not intentionally vented to the outside environment. Those skilled in the art will recognize that the closed nature of system 100 does not mean that there is no leakage.

First fluid storage vessel 110 is a suitable vessel for storing a gaseous fluid such as fluid 111. Gaseous fluid 111 is a fluid that is in a gaseous state at ambient temperatures that the power generation unit typically operates in. Typically, the ambient temperatures would be between −30 and 60 degrees centigrade. Fluid 111 can be, for example, methane, natural gas, nitrogen, or atmospheric air. Vessel 110 stores fluid 111 at pressures that exceed the ambient atmospheric pressure. In one example, vessel 110 stores fluid 111 at a pressure of $3\times10^7$ Pa.

Second fluid storage vessel 112 is a vessel suitable for storing a fluid 113 in its liquid state. Fluid 113 is a fluid that is in a generally liquid or solid state at ambient temperatures. Fluid 113 can be, for example, ammonia or water. In some embodiments, storage vessel 112 is an insulated vessel that helps prevent fluid 113 from solidifying at ambient temperatures that are below the freezing point of fluid 113. In some embodiments, vessel 112 includes a heating element that provides heat to storage vessel 112 to help prevent the solidification of fluid 113. Further, in some embodiments, fluid 113 can be stored at a pressure which is greater than the ambient pressure.

Engine 120 is an external combustion engine whereby a heated fluid is provided to the engine to generate power. Engine 120 is a mechanical expander (e.g. piston or turbine) that is configured to convert the energy contained in a gas or gas vapor into mechanical energy. This can be achieved through thermodynamic pressure volume principles. Engine 120 receives fluid from either first storage vessel 110, second storage vessel 112, or a combination of the two. Engine 120 provides a mechanical output of the energy in the fluid via shaft 122. However, other components capable of producing a mechanical output can be present. Shaft 122 rotates in response to the movement of internal components 124 of the engine 120. Shaft 122 can provide rotational power to a number of devices. For example, power can be provided to wheels, paddles, compressors, electrical generators, and/or the like. In the embodiment illustrated in FIG. 1 shaft 122 powers a compressor 160 and at least one wheel 165.

Depending on the type of engine 120 present in power generation unit 100 different components may be present as internal components 124. For example, if engine 120 is a piston engine then internal components 124 may include pistons, a crankshaft, valves and other components associated with piston engines. However, if for example, engine 120 is a turbine engine, then internal components 124 may include a turbine and blades. For purposes of this discussion, engine 120 is discussed as a piston engine; however, those skilled in the art will readily be able to convert the teachings disclosed herein to other types of engines.

Engine 120 receives fluid (fluid 111, 113 or a combination thereof) from boiler 134 through lines 152-1 and 152-2. Engine 120 exhausts the fluid through line 154. This exhaust fluid is passed to radiator 140. Radiator 140 provides a way for the fluid leaving the engine to cool. Radiator 140 can be any form of radiant cooler. For example, a series of coils can be used through which fluid flows. The coils can be made from a material that allows for the rapid absorption and dissipation of heat energy. Coils can be exposed to the ambient air so that the ambient air assists in removing heat from the coils and thus from the fluid. In some embodiments, a fan or other assisted cooling device may be produced to increase the air flow over the radiator. As the fluid in radiator 140 cools, fluid 113 will return to its liquid state, while fluid 111 remains in its gaseous state. Fluid 111 exits radiator 140 via line 156, while fluid 113 exits the radiator via line 157. Further in some embodiments, storage vessel 110 is integral to radiator 140.

Fluid 111 is provided to compressor 160 from radiator 140. In one embodiment, compressor 160 is a two stage compressor that raises the pressure of fluid 111 from a pressure leaving the radiator to the original pressure level in a two stage process. The first stage 161 raises the pressure of fluid 111 to an intermediate level, and the second stage 162 raises the pressure of fluid 111 from the intermediate pressure to the final pressure. For example, compressor 160 can raise the pressure of fluid 111 from $1\times10^6$ Pa (the pressure leaving the radiator) to $5\times10^6$ Pa at stage 161, and then from $5\times10^6$ Pa to $3\times10^7$ Pa at stage 162. Fluid 111 is then provided back to vessel 110 via line 158. To prevent back flow of the compressed fluid from vessel 110 to the compressor over line 158, a recovery valve 159 is disposed at the point where line 158 intersects line 151. Recovery valve 159 is, in one embodiment, a one-way valve that has an opening pressure that is less than the pressure provided over line 158.

Heater 130 is a component configured to heat fluids 111 and 113 such that the associated pressure on the fluids increases. In one embodiment, heater 130 is a flash heater capable of rapidly heating fluids 111 and/or 113 to, for example, 1600° C. Heater 130 is divided into two sections, a burner 132 and a boiler 134. Burner 132 generates heat by burning or using a fuel source, such as fuel source 133. Fuel source 133 can provide any fuel that generates heat through burning or other means (e.g. wood, oil, coal, nuclear, etc.). The amount of fuel provided to the heater can be controlled through flow control valve 135. By regulating the flow of fuel, the temp of the heater can be controlled in some embodiments. However, regulating the flow of fuel is only one method of controlling the temperature of the heater. Other methods may include regulating a fuel/oxidizer ratio. Still other methods, such as those known in the nuclear energy arts may be used. The heat generated in burner 132 is transferred to boiler 134.

Boiler 134 is a vessel that is configured to receive fluid 113 in its liquid state and to output the fluid in a gaseous state at an elevated temperature and pressure. Boiler 134 receives fluid 113 via line 150, and outputs the fluid in the gaseous state through lines 152-1 and 152-2. The flow of fluid 113 is controlled by thermostat 136 and control circuitry 170. Thermostat 136 restricts the flow of fluid 113 when boiler 134 is cold and increases flow when boiler 134 is hot. In some embodiments, fluid 111 is provided to boiler 134 at the same time. In this embodiment, fluids 111 and 113 are mixed and heated in boiler 134. The mixed fluids are then output through lines 152-1 and 152-2.

Control circuitry 170 is provided to regulate the activities of system 100. Control circuitry 170 can be any type of controller or control circuitry (e.g. processor, logic board, computer code, etc.) The operator indicates a desired activity, such as acceleration, to the control circuitry via interactive device 173 (e.g. a throttle pedal). Control circuitry 170 also regulates the flow of fluid 113. This control can be based on feedback received from thermostat 136 or can be based on other factors. Further, control circuitry 170 can regulate the flow from fuel source 133 based on demands of the system. Control circuitry 170 can regulate the temperature of the gas and hence pressure, for example, based on information related to power demand, fuel flow, and air flow. Based on the demands on system 100, control circuitry regulates the fluid flows through regulators 172 and 175.

Figure 2:
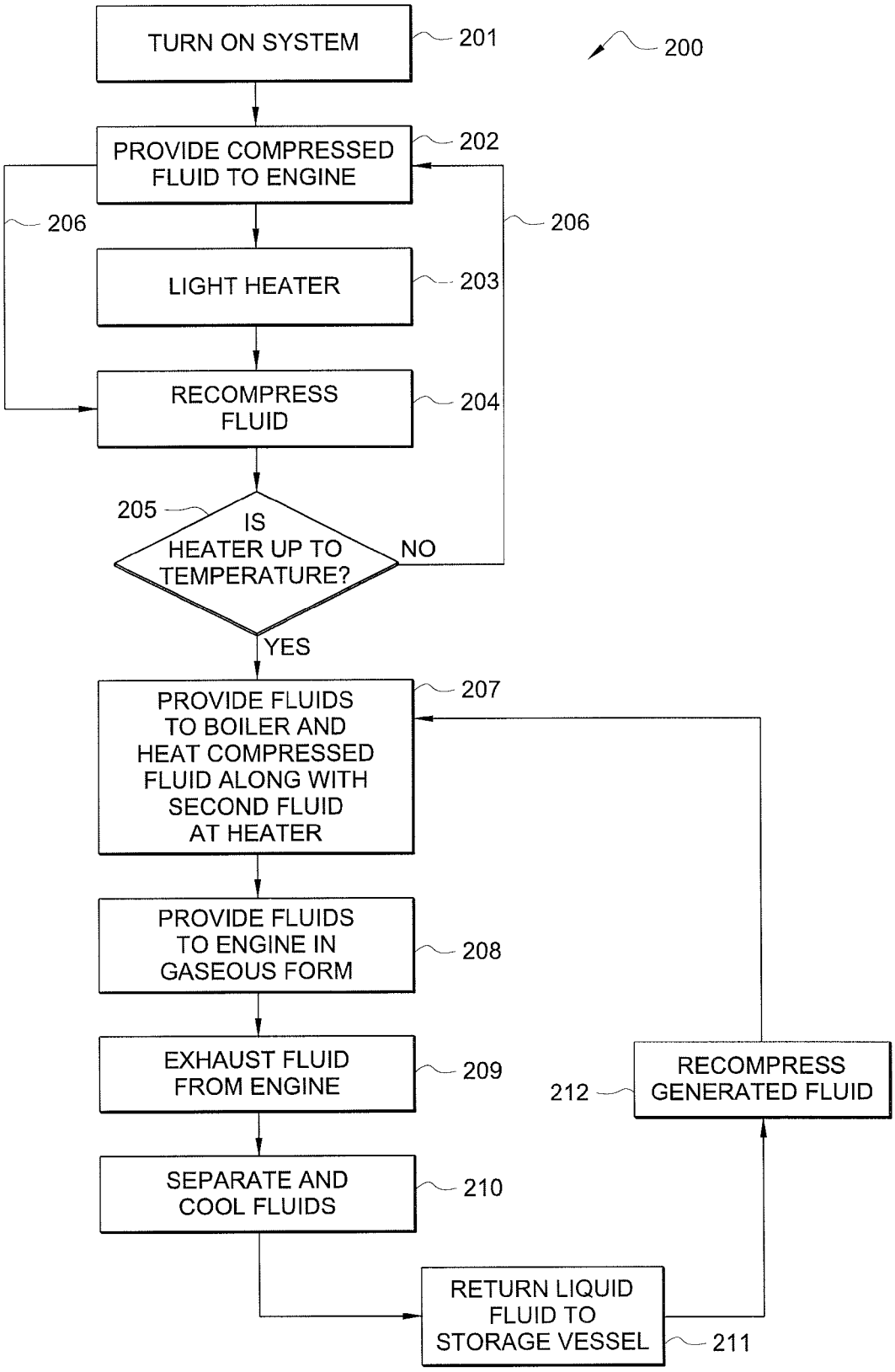
FIG. 2 is a flow diagram illustrating a process for operating the power generation system according to one embodiment.

FIG. 2 is a flow diagram illustrating a process 200 for using the power generation system 100 discussed in FIG. 1 according to one embodiment. For purposes of this discussion, it is presumed that power generation unit 100 is a piston engine disposed within an automobile or vehicle. However, it should be understood that the present invention is not limited thereto. Additionally, reference made herein to various elements of the system refer to elements illustrated in FIG. 1.

Initially, a user of the automobile needs to "start" the vehicle. By starting, it is meant placing the vehicle in an operating mode whereby the external combustion engine can be used. To start the vehicle, the user switches toggle 171-3 to change master switch 171-2 from an "off" position to an "on" position at process 201. When the master switch is off, the vehicle is in a non-operating safe mode. When master switch 171-2 is in the off position, the flow of fluid 111 is prevented by valve 171. An electrical supply is provided from battery 180, which supplies minimal power to control circuitry 170 and heater 130. By switching master switch 171-2 to the on mode, battery 180 proceeds to provide sufficient power to operate both control circuitry and to ignite burner 132 of heater 130. Also at process 201, valve 171 is opened and fluid 111 is permitted to flow through lines 153 and 174.

Fluid 111 is provided to engine 120 at process 202. The flow of fluid 111 is controlled through the use of interactive device 173 such as a typical pedal that is found in an automobile. Interactive device 173 communicates through control circuitry 170 with regulator 172 to regulate the flow of fluid 111. Fluid 111 passes through venturi 177 to the boiler 134, and is injected at pressure into engine 120. This flow of fluid 111 acts to start the engine; however, at this time there is no "steam" being produced, and engine 120 initially operates on the compressed gas (i.e. fluid 111) provided from storage vessel 110. The compressed gas causes the piston in engine 120 to expand the displacement volume in the cylinder. This movement of the piston causes shaft 122 to rotate, providing power to the wheel 165. This expansion reduces the temperature and pressure of fluid 111.

At process 203, the burner 132 is lighted or otherwise begins heating the boiler 134. Fluid 113 is provided to the boiler at this time from vessel 112 via conduit means 150, and regulated by flow regulator 175. Fluid 113 is introduced alone or in parallel with fluid 110 through venturi means 177. As burner 132 is heated by fuel from fuel source 133, fluid 113 increases in temperature. The lighting of burner 132 can occur at the time the vehicle is turned on, or can occur at a point later in the process. Further, while waiting for fluid 113 to heat up and vaporize, fluid 111 passes through boiler 134 unobtrusively.

Fluid 111 exits engine 120 through line 154 and passes through radiator 140 then enters compressor 160 via line 156. Through compressor 160, fluid 111 is compressed to the original starting pressure at process 204 and returned to vessel 110 or pumped directly back into boiler 134 via line 158. For example at stage 161, the pressure of fluid 111 is raised from $1\times10^6$ Pa to $5\times10^6$ Pa. Then at stage 162, fluid 111 is increased from $5\times10^6$ Pa to $3\times10^7$ Pa. The compressor, at this stage in process 200, is powered by battery 180, as the work generated by engine 120 through shaft 122 is directed towards the driving of wheel 165 of the vehicle. However, in other embodiments, shaft 122 may provide some power to compressor 160. Following process 204, the compressed fluid 111 is returned to vessel 110 for storage or is directed back in process 205 through the heater 130 and engine 120 to provide more power to the engine. Processes 202, 204 and 205 are repeated until the boiler has received sufficient temperature that fluid 113 (initiating gaseous state) can provide adequate pressure volume work to move the vehicle. This is illustrated by path 206.

In process 207, once the temperature of fluid 113 reaches its boiling point (i.e. 100° C. for water), fluid 113 becomes a gas and continues to heat. The continuous heating of fluid 113 in its gaseous state increases the pressure of the fluid in boiler 134. Once the pressure in the boiler 134 reaches a suitable pressure for generating power, gaseous fluid 113 can be injected into engine 120. Through the use of the heater 130, the gaseous fluid 113 can be heated such that the pressure in the system exceeds the pressure generated from compressed fluid 111; however, in some embodiments, the compressed fluid 111 can be included in the fluid mixture, or upon reaching the desired pressure in boiler 134, fluid 111 can be shut off. This is illustrated at process 208. While fluid 113 is heating additional fluid 111 and/or 113 can be provided to the boiler. The proportion of fluid 111 and fluid 113 conveyed to the boiler is regulated by control circuitry 170, and the proportional flow is regulated by regulators 175 and 172. The mixing of fluid 111 and fluid 113 in regulated proportions occurs at venturi 177. This additional fluid is provided to ensure that there is sufficient fluids available to generate the desired pressures.

Fluid 113 (or 111 and 113) enters engine 120, whereby the volume of the fluid expands at process 208. The pressure of the fluid causes internal components 124 to move downward, thus expanding the volume of the cylinder. This expansion of the volume, where the fluid 113 is located in engine 120, causes a reduction in both the temperature and pressure of the fluid. In one embodiment, the temperature of the fluid drops to the point where fluid 113 is close to the temperature at which it condenses (e.g. within 10° C. of the condensing temperature).

Following movement of internal components 124 in engine 120, the exhaust gas comprising fluid 113 and/or fluid 111 exits the engine 120 via line 154 and is directed to radiator 140 at process 209. The fluid then cools in radiator 140 at process 210. During this cooling the fluid 113 returns to its liquid state, and fluid 111 remains in its gaseous state. This acts to separate the two fluids from each other such that they can be recollected and reused in system 100. Fluid 113 is returned to vessel 112, via line 157, where it can continue to cool or can be sent back to heater 130 for reheating and repressurization at process 211. Likewise, fluid 111 is returned to vessel 110 via line 158 after being recompressed in compressor 160 at process 212.

The embodiments discussed above with respect to FIGS. 1 and 2 illustrate but one approach to implementing the present invention. It will be readily appreciated that various features illustrated in FIG. 1 can be added or removed, so long as engine 120 is configured to receive first fluid 111 and second fluid 113 to perform work. The components used for directing, heating, storing and compressing these fluids can be easily switched for other components performing substantially the same functions in the system.

The present invention provides significant advantages over prior art external combustion engines. Specifically, through the use of the compressed fluid 111 to initially power the engine during start-up, the user is able to extract some, albeit less than full power from the engine. This reduced power allows immediate response from the system that a user desires, for example causing a vehicle to move, without having to wait for the system to fully heat up. Once the system is up to temperature full power is available using either the second fluid or a combination of the first and second fluids.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A power generation unit comprising:

a first vessel holding a quantity of a first pressurized gaseous working fluid that is gaseous at ambient temperature at a pressure substantially greater than ambient pressure;

a second vessel holding a quantity of a second working fluid that is in a liquid state at ambient temperature;

a controllable heater in controllable communication with at least said second vessel for heating at least said second working fluid;

an engine in controllable communication with said heater and said first vessel, such that said engine can receive said first pressurized gaseous working fluid and/or receive said second working fluid, having been heated by said heater to be vaporized and form a second pressurized gaseous working fluid, said first and/or second pressurized gaseous working fluids being supplied to at least one chamber in said engine where said pressurized gaseous working fluids can expand, causing said engine to produce power;

a liquid recovery device for condensing said second pressurized gaseous working fluid following expansion in and exhaust from said engine, and separating said first and second working fluids and supplying at least said second working fluid back to said second vessel; and a controller for controlling heating of said at least second working fluid in said heater, and flow of said first and second working fluids from the respective vessels to the heater and to said at least one chamber of the engine responsive to an operator request, whereby when an operator requests that said engine produce power at a time when said second working fluid is not heated sufficiently to form a second pressurized gaseous working fluid capable of being expanded in said at least one chamber of said engine to produce power, said controller controls flow of said first pressurized working fluid from said first vessel to said at least one chamber of said engine, causing said engine to produce power, and also causes said heater to heat said second working fluid to be vaporized to form a second pressurized gaseous working fluid, and after said second pressurized gaseous working fluid has been formed by vaporizing said second working fluid, controls supply of said second pressurized gaseous working fluid to said at least one chamber of said engine, partially or wholly in lieu of the first pressurized gaseous working fluid, to cause said engine to produce power in response to the operator's request.

2. The power generation unit of claim 1 further comprising:

a compressor recompressing said first working fluid back to said pressure substantially greater than ambient pressure following exhaust from said engine.

3. The power generation unit of claim 2 wherein said compressor is powered by an auxiliary power source when said second working fluid is not heated sufficiently to form a second pressurized gaseous working fluid capable of being expanded in said engine to produce power, and is powered by said engine when said second working fluid is heated sufficiently to form a second pressurized gaseous working fluid capable of being expanded in said engine to produce power.

4. The power generation unit of claim 1 wherein said heater comprises a heating element and a boiler element.

5. The power generation unit of claim 4 wherein the heating element is a flash heater.

6. A method for operating an engine responsive to selective supply of two different pressurized gaseous working fluids to at least one chamber of said engine wherein the pressurized gaseous working fluids can expand, causing said engine to produce power, comprising the steps of:

providing a supply of a first pressurized working fluid which is gaseous at ambient temperature;

providing a supply of a second working fluid that is liquid at ambient temperature, and which can be heated to form a supply of a second pressurized gaseous working fluid;

providing a controller which, in response to an operator request that the engine produce power, performs the following steps:

starting said engine by supplying said first pressurized gaseous working fluid to said at least one chamber of said engine, causing said engine to produce power;

supplying said second working fluid to a boiler in liquid form;

applying heat to said boiler to convert said liquid second working fluid to a second pressurized gaseous working fluid; and when said second pressurized gaseous working fluid is available, providing said second pressurized gaseous working fluid from said boiler to said at least one chamber of said engine wholly or partially in lieu of said first pressurized gaseous working fluid, causing said engine to produce power.

7. The method of claim 6 wherein said step of providing said first pressurized gaseous working fluid to said engine further comprises the steps of:

providing said first pressurized gaseous working fluid to said boiler, further pressurizing said first gaseous working fluid, and providing said further pressurized first gaseous working fluid to said engine from said boiler.

8. The method of claim 6 comprising the further steps of:

collecting said first pressurized gaseous working fluid upon exhaust from said engine and recompressing said first pressurized gaseous working fluid.

9. The meted of claim 6 wherein said first and second pressurized gaseous working fluids are exhausted from said engine at a pressure and temperature lower than the pressure and temperature at which they are admitted to the engine; and comprising the further step of:

condensing said second pressurized gaseous working fluid such that it is returned to the liquid state.

10. The method of claim 6 comprising the further steps of:

regulating the flow of said first and second pressurized gaseous working fluids to control the amount of power generated by said engine.

11. An automobile power system comprising:

a first fluid storage tank storing a first working fluid which is gaseous at ambient temperature in a gaseous state under a pressure substantially greater than ambient pressure;

a second fluid storage tank storing a second working fluid which is in a liquid state at ambient temperature;

a heater coupled to at least said second fluid storage tank, and configured to heat said second working fluid to a temperature above a vaporization temperature of said second working fluid, forming a second gaseous working fluid;

an engine configured to controllably receive said first gaseous working fluid from said first fluid storage tank and to controllably receive, said second gaseous working fluid from said heater, whereby said first and second gaseous working fluids expand in at least one chamber of said engine, causing said engine to produce power;

a cooling system configured to condense said second working fluid from said gaseous state to said liquid state after exhaust from said engine; and a controller responsive to an operator request for controlling heating of said at least second working fluid in said heater, and flow of said first and second working fluids from the respective vessels to the heater and to said at least one chamber of the engine, whereby when an operator requests that said engine produce power at a tune when said second working fluid is not heated sufficiently to form a second gaseous working fluid capable of being expanded in said engine to produce power, said controller controls flow of said first gaseous working fluid from said first vessel to said at least one chamber of said engine, causing said engine to produce power, and also causes said heater to heat said second working fluid to be vaporized to form a second gaseous working fluid, and after said second gaseous working fluid has been formed by vaporizing said second working fluid, controls supply of said second gaseous working fluid to said at least one chamber of said engine, partially or wholly in lieu of the first gaseous working fluid, to cause said engine to produce power in response to the operator's request.

12. The automobile power system of claim 11 wherein the heater comprises:

a heating element; and a boiler, said boiler configured to hold at least said second working fluid until said second working fluid is vaporized and reaches a pressure at which said second working fluid is capable of causing said engine to produce power.

13. The automobile power system of claim 11 wherein said engine is a piston engine.

14. The automobile power system of claim 11 wherein said engine is a turbine engine.

15. The automobile power system of claim 11 wherein said cooling system receives both said first and said second working fluids.

16. The automobile power system of claim 15 wherein said cooling system is further configured to separate said first working fluid from said second working fluid.

17. The automobile power system of claim 11 further comprising:

a compressor configured to compress said first fluid to said greater than ambient pressure.

18. The automobile power system of claim 11, further comprising a generator powered by said engine for generating electric power, said electric power powering at least one electric motor disposed on said automobile.

19. The automobile power system of claim 11 wherein said engine generates motive power to propel said automobile.

20. The automobile power system of claim 12 wherein power produced by said engine turns a shaft connected to wheels of an automobile for propulsion.

21. A power generation unit comprising:

means for storing a first pressurized gaseous working fluid;

means for storing a liquid fluid;

means for heating said liquid fluid to a temperature above a vaporization temperature of said liquid fluid to form a second pressurized gaseous working fluid, said means for heating being controllably connected to at least said means for storing said liquid fluid;

an external combustion engine, controllably connected to said means for storing a first pressurized gaseous working fluid and to said means for heating at least said liquid fluid to vaporize said liquid fluid to form a second pressurized gaseous working fluid, whereby supply of first pressurized gaseous working fluid and/or said second pressurized gaseous working fluid to at least one chamber of said engine causes said engine to produce power;

a condenser for condensing said second pressurized gaseous working fluid back to said liquid fluid, and a controller responsive to an operator request for controlling heating of at least said liquid fluid in said means for heating, and flow of said first and second pressurized gaseous working fluids to the means for heating and to the engine, whereby when an operator requests that said engine produce power at a time when said liquid fluid is not heated sufficiently to form a second gaseous pressurized working fluid capable of being supplied to said at least one chamber of said engine to produce power, said controller controls flow of said first gaseous working fluid to said at least one chamber of said engine, causing said engine to produce power, and also causes said means for heating to heat said second working fluid to be vaporized to form a second pressurized gaseous working fluid, and after said second pressurized gaseous working fluid has been formed by vaporizing said second working fluid, controls supply of said second pressurized gaseous working fluid to said at least one chamber of said engine, partially or wholly in lieu of the first gaseous working fluid, to cause said engine to produce power in response to the operator's request.

22. The power generation unit of claim 21 wherein said condenser further comprises a means for separating said first pressurized gaseous working fluid from said liquid fluid.

23. The power generation unit of claim 1, wherein said first pressurized gaseous working fluid is also supplied to said heater for additional pressurization thereof before supply to said engine.

24. The automobile power system of claim 11, wherein said first pressurized gaseous working fluid is also supplied to said heater for additional pressurization thereof before supply to said engine.

25. The power generation unit of claim 21, wherein said first pressurized gaseous working fluid is also supplied to said means for heating for additional pressurization thereof before supply to said engine.

* * * * *